US005934384A

United States Patent [19]

Wang

[11] Patent Number: 5,934,384

[45] Date of Patent: Aug. 10, 1999

[54] TRANSMISSION SHAFT AND BIT MOUNTING ARRANGEMENT OF A MOTOR-DRIVEN HAND DRILL

[76] Inventor: Peter Wang, No. 50-1, Lane 60, Chien-Ping 9th Street, An-Ping Dist., Tainan, Taiwan

[21] Appl. No.: 09/067,598

[22] Filed: Apr. 27, 1998

[51] Int. Cl.[6] ..... B25B 23/16

[52] U.S. Cl. ..... 173/132; 81/177.85; 279/75

[58] Field of Search ..... 173/132, 171; 81/177.85; 403/325; 279/75, 76

[56] References Cited

U.S. PATENT DOCUMENTS

| | | | |
|---|---|---|---|
| 3,222,959 | 12/1965 | Clark | 81/177.85 |
| 4,768,405 | 9/1988 | Nickipuck | 403/325 |
| 4,934,221 | 6/1990 | Hsiao | 81/177.85 |
| 4,938,107 | 7/1990 | Nickipuck | 81/177.85 |
| 5,287,776 | 2/1994 | Williams et al. | 81/177.85 |
| 5,813,296 | 9/1998 | Hoff et al. | 81/177.85 |
| 5,873,289 | 2/1999 | Jarvis | 403/325 |

*Primary Examiner*—Scott A. Smith
*Attorney, Agent, or Firm*—Dougherty & Troxell

[57] ABSTRACT

A transmission shaft and bit mounting arrangement includes a transmission shaft, a C-shaped clamping ring fixed to the outside wall of the shaft, a chuck and locating ring fastened together and moved axially on the shaft relative to the C-shaped clamping ring, a compression spring mounted around the shaft and stopped between the C-shaped clamping ring and the locating ring, a bit mounted in a polygonal coupling hole at one end of the shaft, a magnet mounted in the polygonal coupling hole to attract the bit, and a stop member mounted in a hole on the shaft and controlled by the chuck to stop the bit in the polygonal coupling hole.

3 Claims, 7 Drawing Sheets

TRANSMISSION SHAFT AND BIT MOUNTING ARRANGEMENT OF A MOTOR-DRIVEN HAND DRILL

BACKGROUND OF THE INVENTION

The present invention relates to a transmission shaft and bit mounting arrangement of a motor-driven hand drill which uses a magnet to attract the bit, and a stop member controlled to stop the bit from axial movement.

FIG. 1 shows the bit mounting arrangement of a motor-driven hand drill according to the prior art. According to this arrangement, a bit A is mounted in a coupling hole C1 on a chuck C, and a tool D is used to fix the bit A and the chuck C together, enabling the bit A to be turned with the chuck C by a motor drive B. This arrangement has drawbacks. During the operation of the motor-driven hand drill, the bit A tends to be forced out of the coupling hole C1 of the chuck C by the vibration of the motor drive B. Further, the procedure of replacing the bit A is complicated because the tool D must be used.

SUMMARY OF THE INVENTION

The present invention has been accomplished to provide a transmission shaft and bit mounting arrangement which eliminates the aforesaid drawbacks. According to the invention, the transmission shaft and bit mounting arrangement comprises a transmission shaft, a C-shaped clamping ring fixed to the outside wall of the shaft, a chuck and locating ring fastened together and moved axially on the shaft relative to the C-shaped clamping ring, a compression spring mounted around the shaft and stopped between the C-shaped clamping ring and the locating ring, a bit mounted in a polygonal coupling hole at one end of the shaft, a magnet mounted in the polygonal coupling hole to attract the bit, and a stop member mounted in a hole on the shaft and controlled by the chuck to stop the bit in the polygonal coupling hole. Because of the arrangement of the magnet, the bit and the stop member can be firmly secured in place. Because of the arrangement of the stop member, the bit is stopped from axial movement in the polygonal coupling hole of the transmission shaft. Further, by means of moving the chuck axially on the transmission shaft, the bit can easily be removed from the transmission shaft for a replacement.

DETAILED DESCRIPTION OF THE PREFERRED EMBODIMENT

Figure 1:
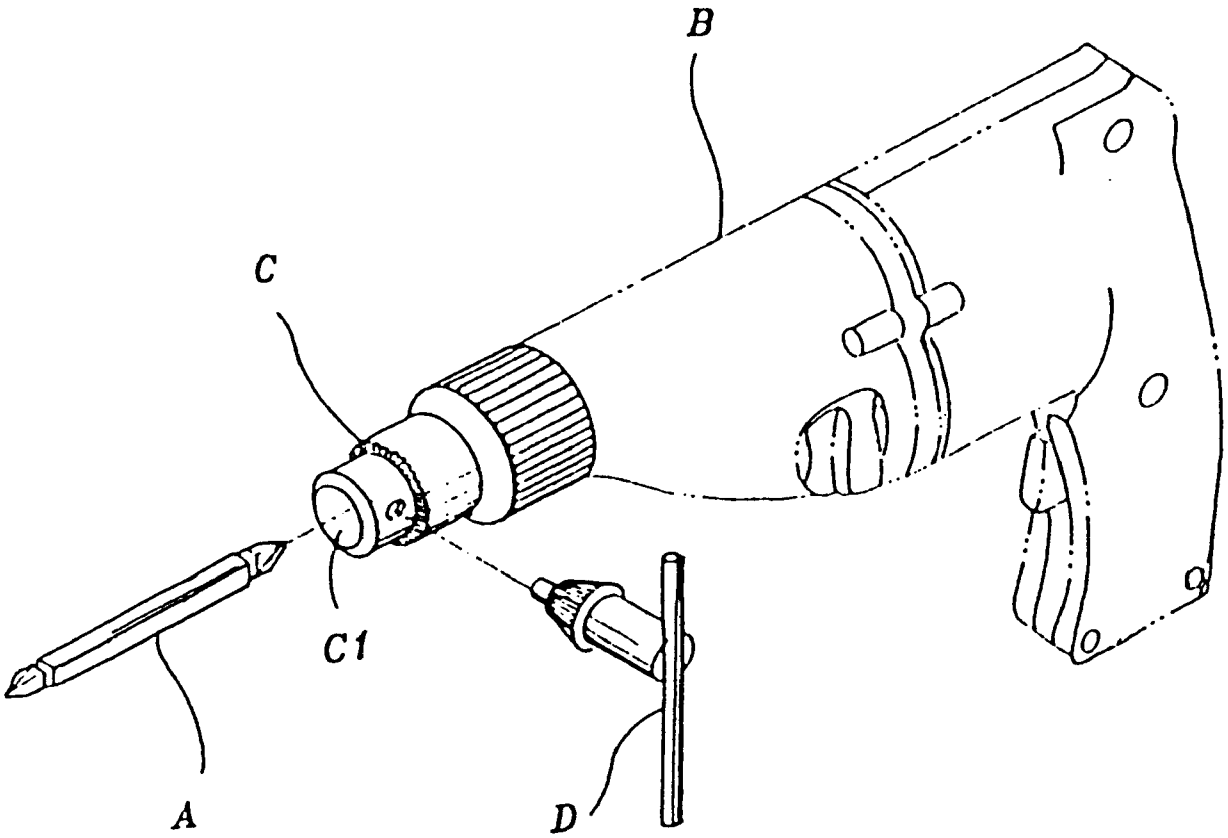
FIG. 1 PRIOR ART
FIG. 1 shows the bit mounting arrangement of a motor-driven hand drill according to the prior art.
Figure 2:
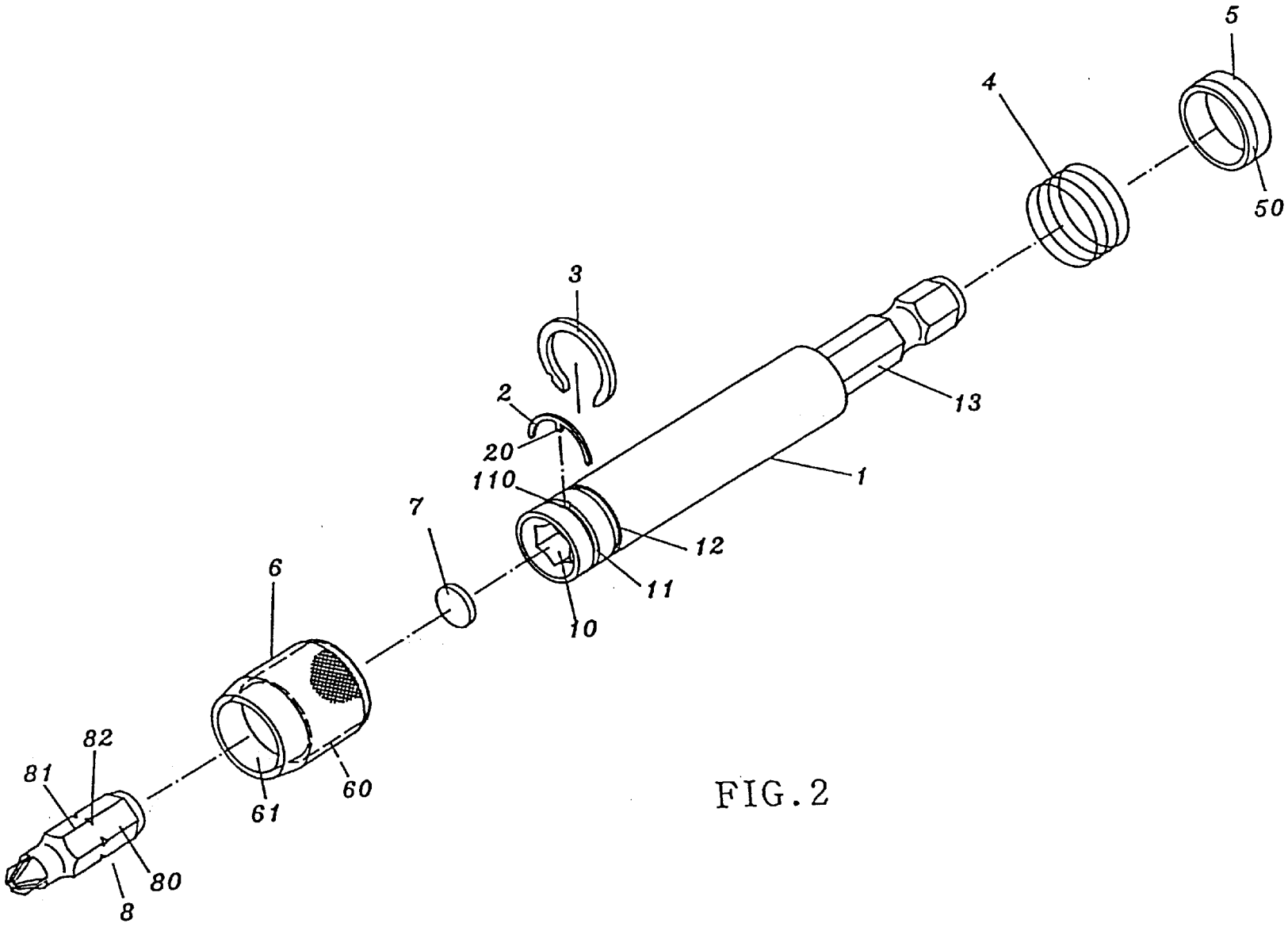
FIG. 2 is an exploded view of a transmission shaft and bit mounting arrangement according to the present invention.
Figure 3:
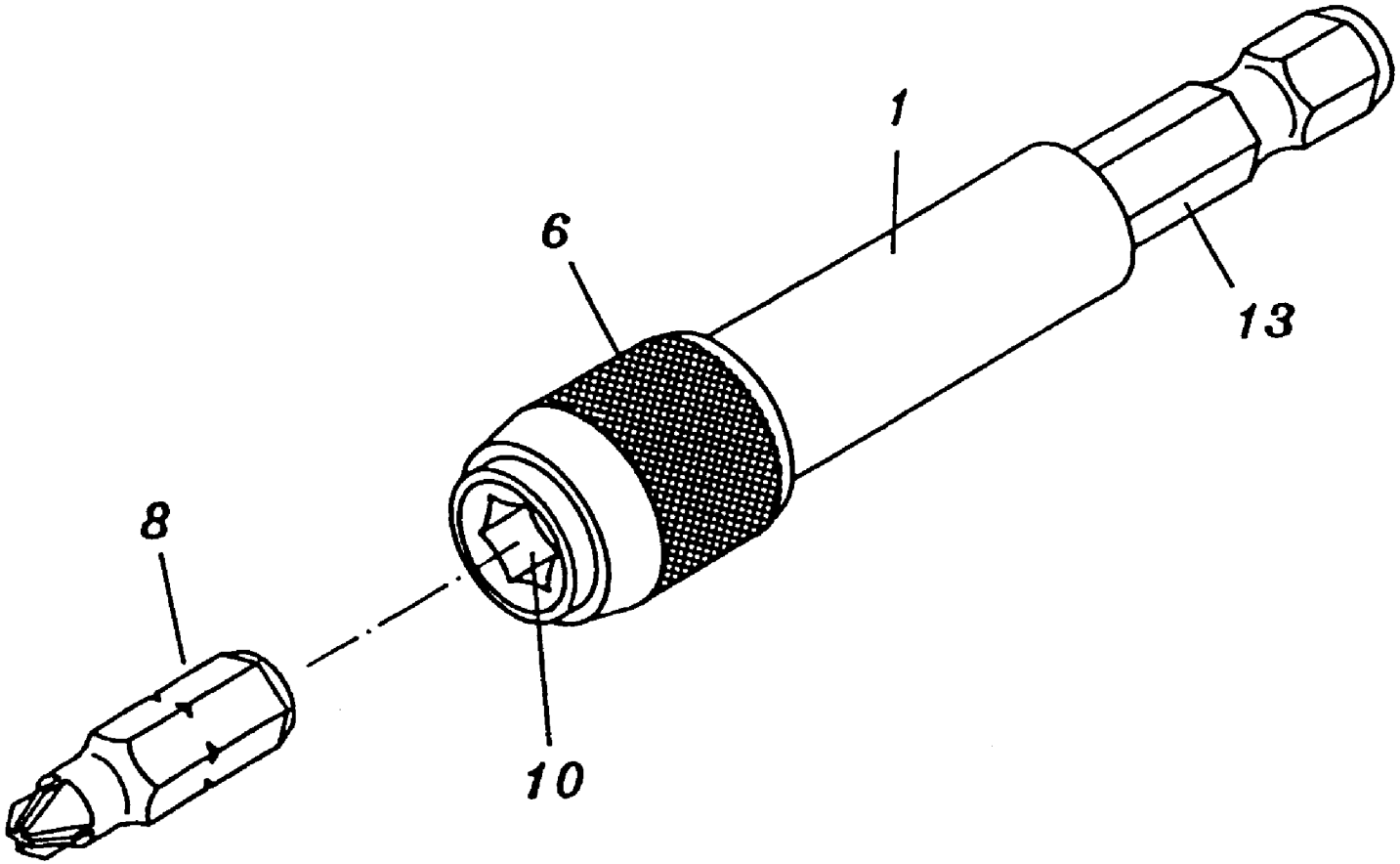
FIG. 3 is an assembly view of FIG. 2 (the bit not installed).
Figure 4:
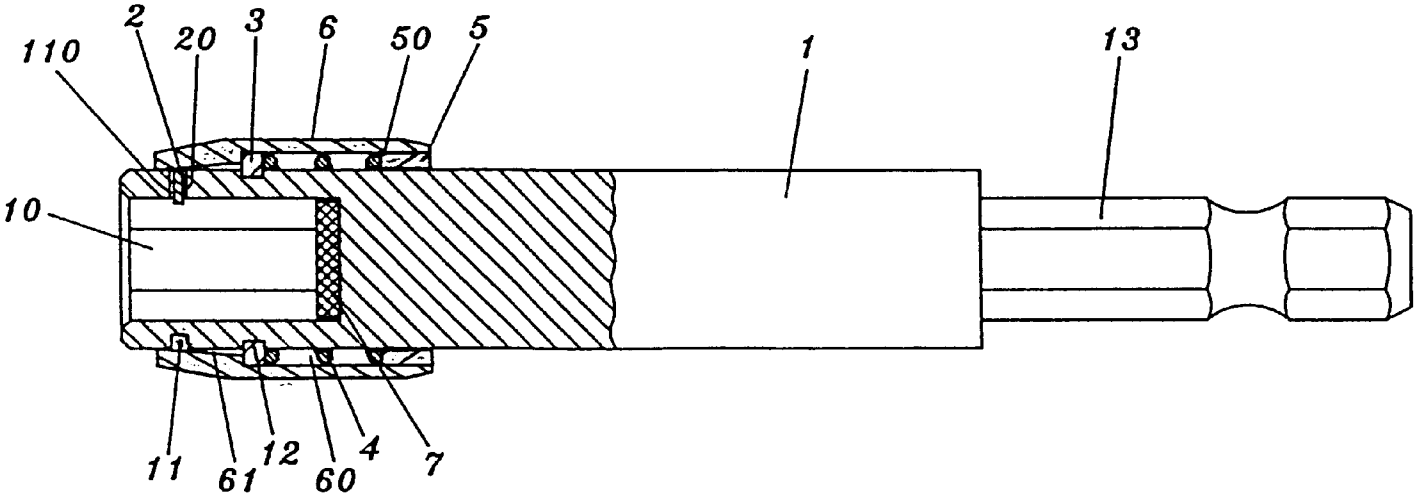
FIG. 4 is a longitudinal view in section of in an enlarged scale of the assembly shown in FIG. 3 (the bit excluded).
Figure 5:
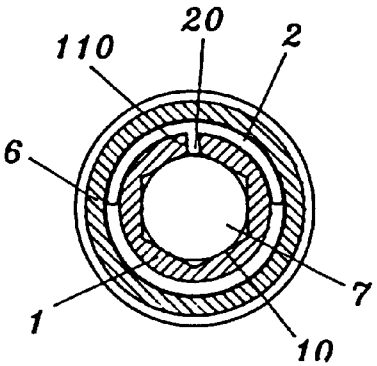
FIG. 5 is a cross sectional view of FIG. 4.

Referring to FIG. 2, the invention is comprised of a transmission shaft 1, a stop member 2, a C-shaped clamping ring 3, a compression spring 4, a locating ring 5, a chuck 6, a magnet 7, and a bit 8.

The transmission shaft 1 comprises a polygonal coupling hole 10 longitudinally extended from one end thereof namely the front end, a locating groove 11 around the periphery of the front end, a through hole 110 at the locating groove 11 in communication with the polygonal coupling hole 10, an annular groove 12 around the periphery of the front end behind the locating groove 11, and a coupling rod 13 longitudinally extended from an opposite end thereof namely the rear end. The stop member 2 has an arched body fitting the locating groove 11, and a protruded rod 20 on the middle for insertion into the through hole 110 on the transmission shaft. The C-shaped clamping ring 3 is for mounting in the annular groove 12 on the transmission shaft 1. The compression spring 4 is for mounting around the outside wall of the transmission shaft 1. The locating ring 5 is for mounting around the outside wall of the transmission shaft 1, having a tapered coupling portion 50 on the outside wall. The chuck 6 is for mounting around the outside wall of the front end of the transmission shaft 1, having a longitudinal center through hole 60. The longitudinal center through hole 60 defines a tapered orifice 61. The tapered orifice 61 has an inner diameter gradually reducing from the longitudinal center through hole 60 toward the outside. The magnet 7 is for mounting in the polygonal coupling hole 10 on the transmission shaft 1. The bit 8 comprises a polygonal shank 80 fitting the polygonal coupling hole 10 on the transmission shaft 1, a cut 82 at each angle 81 of the polygonal shank 80 on the middle.

The assembly process of the invention is outlined hereinafter with reference to FIGS. 2, 3, 4 and 6. The magnet 7 is mounted in the polygonal coupling hole 10 on the transmission shaft 1 at the bottom, then the stop member 2 is mounted in the locating groove 11, permitting the protruded rod 20 to be inserted through the through hole 110 on the transmission shaft 1 into the polygonal coupling hole 10, and then the C-shaped clamping ring 3 is mounted in the annular groove 12 on the transmission shaft 1, and then the compression spring 4 and a locating ring 5 are properly mounted around the transmission shaft 1, permitting the compression spring 4 to be stopped between the C-shaped clamping ring 3 and the locating ring 5, and then the chuck 6 is mounted on the transmission shaft 1 and forced into engagement with the tapered coupling portion 50 of the locating ring 5. When assembled, the stop member 3 is forced down by the periphery of the tapered orifice 61 of the chuck 6, the C-shaped clamping ring 3 is stopped at an inside edge of the chuck 6 between the longitudinal through hole 60 and the tapered orifice 61, and the compression spring 4 is retained within the longitudinal through hole 60 inside the chuck 6 between the C-shaped clamping ring 3 and the locating ring 5.

Figure 6:
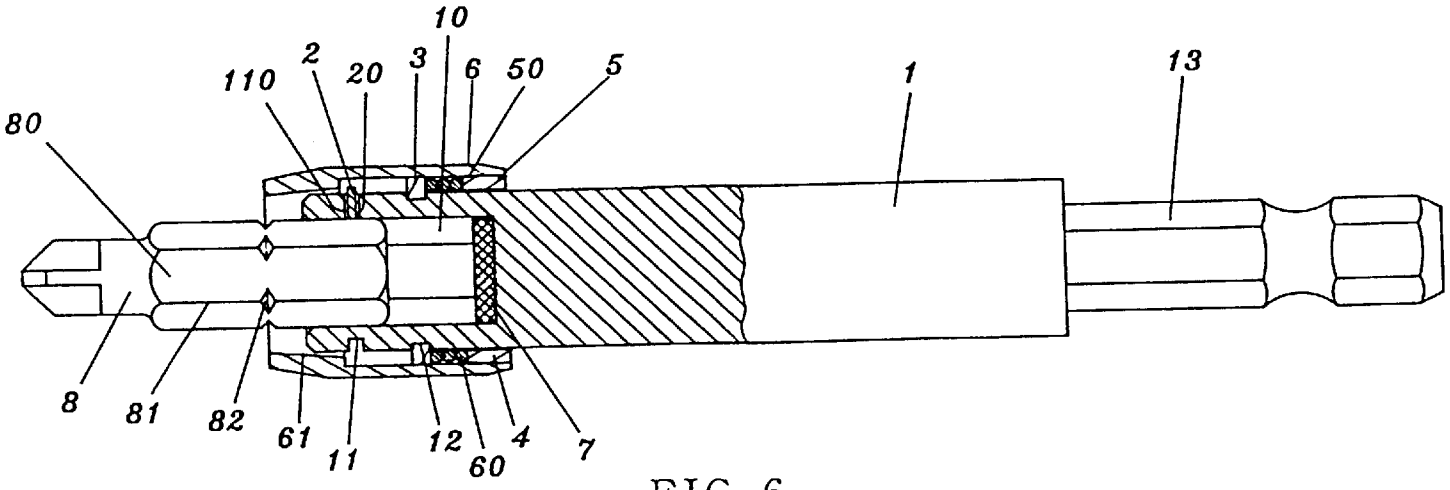
FIG. 6 is another longitudinal view in section of the present invention, showing the chuck pushed forwards, the bit inserted into the polygonal coupling hole of the transmission shaft.
Figure 7:
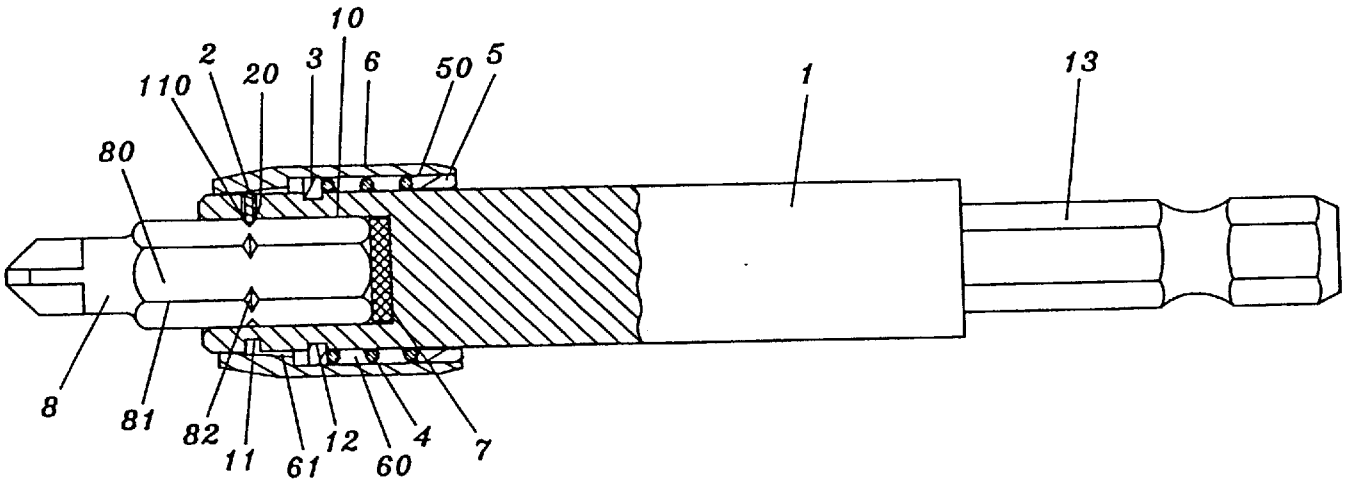
FIG. 7 is similar to FIG. 6 but showing the chuck released, the stop rod of the stop member forced into engagement with one cut on the shank of the bit.
Figure 8:
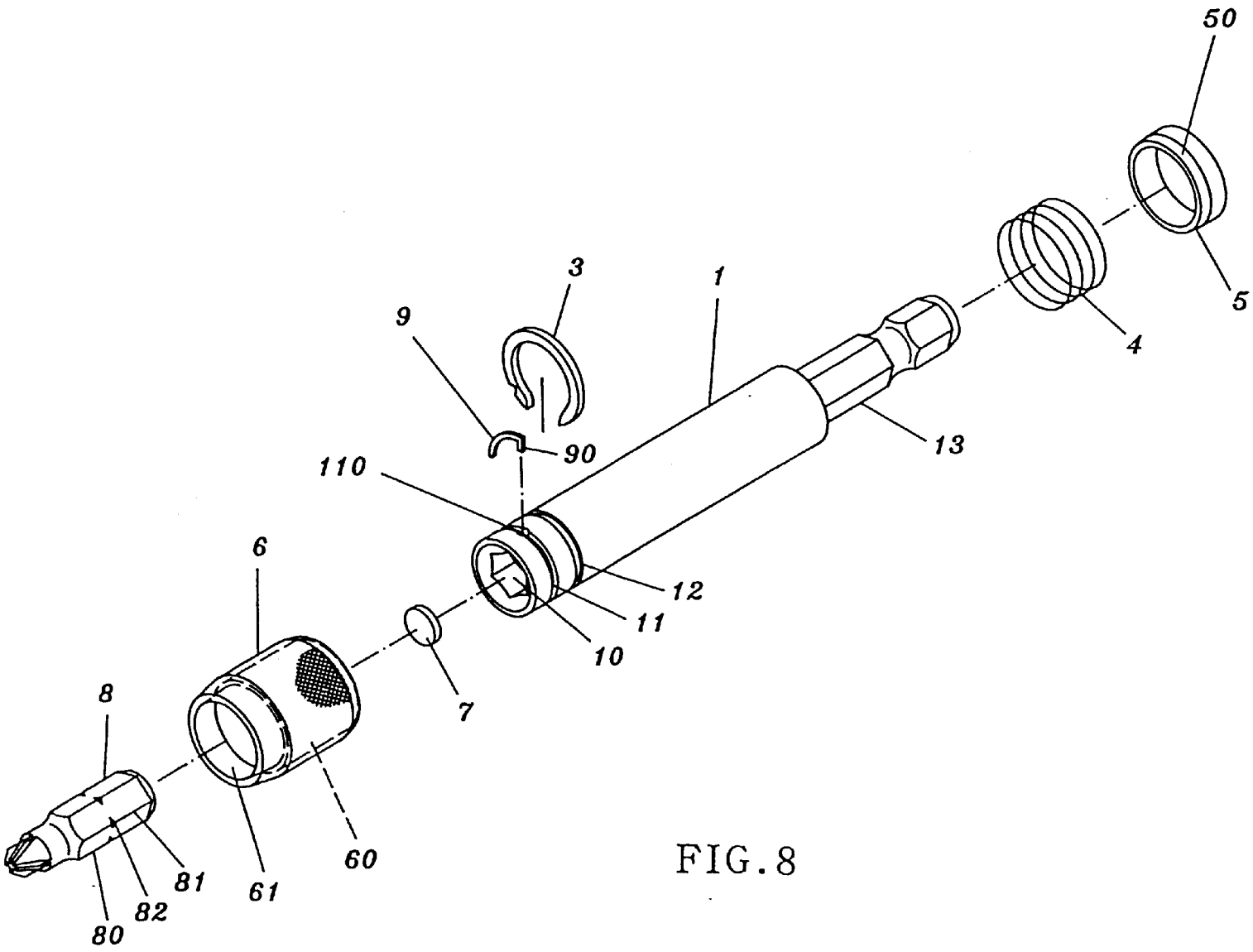
FIG. 8 is an exploded view of an alternate form of the present invention.
Figure 9:
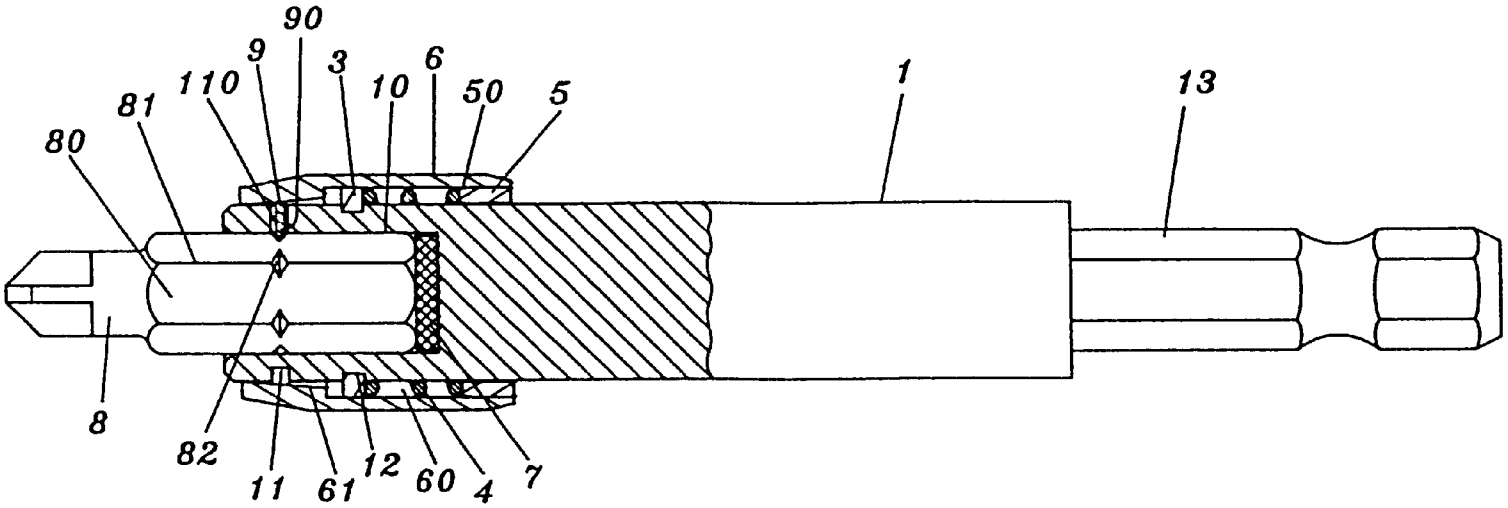
FIG. 9 is a longitudinal view in section of the assembly of the alternate form shown in FIG. 8.
Figure 10:
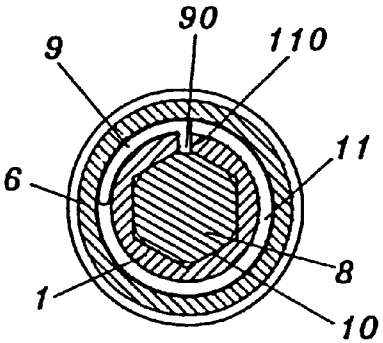
FIG. 10 is a cross sectional view of FIG. 9.

Referring to FIGS. 6 and 7, when the chuck 6 is pushed forwards, the locating ring 5 is moved with the chuck 6 to compress the compression spring 4, and the longitudinal through hole 60 of the chuck 6 is moved to the stop member 2, then the shank 80 of the bit 8 is inserted into the polygonal coupling hole 10 on the transmission shaft 1. Because the stop member 2 is disposed in the longitudinal through hole 60 inside the chuck 6, inserting the shank 80 of the bit 8 causes the stop member 2 to be forced upwards, for permitting the shank 80 of the bit 8 to be inserted into position. When the shank 80 of the bit 8 is set into position, it is attracted by the magnet 7 in the polygonal coupling hole 10 inside the transmission shaft 1. When the chuck 6 is released from the hand after the installation of the bit 8, the chuck 6 is immediately pushed back to its former position by the spring force of the compression spring 4, and the stop member 2 is forced down again by the inside edge between the longitudinal through hole 60 and the tapered orifice 61, causing the protruded rod 20 of the stop member 2 to be forced into engagement with one cut 82 at the shank 80 of the bit 8 (see FIG. 7), and therefore the bit 8 is stopped from axial movement in the polygonal coupling hole 10. When replacing the bit 8, the chuck 6 is pushed forwards again to disengage the stop member 2 from the bit 8, enabling the bit 8 to be removed from the polygonal coupling hole 10 of the transmission shaft 1.

FIGS. from 8 to 10 show an alternate form of the present invention. This alternative form is also comprised of a transmission shaft 1, a stop member 9, a C-shaped clamping ring 3, a compression spring 4, a locating ring 5, a chuck 6, a magnet 7, and a bit 8. The stop member 2 according to this alternate form has a curved body fitting the locating groove 11 on the transmission shaft 1, and a stop rod 90 at one end inserted into the through hole 110 on the transmission shaft 1.

What the invention claimed is:

1. A transmission shaft and bit mounting arrangement comprising a transmission shaft, said transmission shaft comprising a polygonal coupling hole longitudinally extended from a front end thereof and an annular groove around a periphery of the front end, a C-shaped clamping ring mounted in the annular groove outside said transmission shaft, a chuck sleeved onto said transmission shaft around said C-shaped clamping ring, a locating ring mounted around said transmission shaft and fastened to one end of said chuck and moved with said chuck axially relative to said C-shaped clamping ring, a compression spring mounted around said transmission shaft and stopped between said C-shaped clamping ring and said locating ring, and a bit having a polygonal shank fitted into the polygonal coupling hole on said transmission shaft, wherein: said transmission shaft comprises a locating groove on the periphery of the front end in front of said annular groove, and a through hole at said locating groove in communication with said polygonal coupling hole; said bit comprises a cut at each angle of the polygonal shank; a stop member is mounted in the locating groove on said transmission shaft, said stop member having a stop rod inserted through the through hole on said transmission shaft into engagement with one cut on said bit to stop said bit from axial movement in said polygonal coupling hole of said transmission shaft; a magnet is fixedly mounted in the polygonal coupling hole inside said transmission shaft to attract said bit; said chuck comprises a longitudinal through hole and a tapered orifice at one end of the longitudinal through hole, said tapered orifice having an inner diameter gradually reducing from said longitudinal through hole toward an outside end, said chuck being moved axially on said transmission shaft between a first position where said stop member is forced downwards by said tapered orifice, causing the stop rod of said stop member to be forced into engagement with one cut on said bit, and a second position where said longitudinal through hole is moved to said stop member, enabling said stop rod of said stop member to be moved with said stop member up and down in the through hole at the locating groove of said transmission shaft.

2. The transmission shaft and bit mounting arrangement of claim 1 wherein said stop rod is integral with a middle part of an arched body of said stop member.

3. The transmission shaft and bit mounting arrangement of claim 1 wherein said stop rod is integral with one end of a curved body of said stop member.

* * * * *